US005092699A

United States Patent [19]

Silvenis

[11] Patent Number: 5,092,699

[45] Date of Patent: Mar. 3, 1992

[54] FLOOR CLEANING USING INDEX FABRIC ROLLS IN REMOVABLE CASSETTE

[75] Inventor: Scott A. Silvenis, Midland, Mich.

[73] Assignee: DowBrands, Inc., Indianapolis, Ind.

[21] Appl. No.: 662,984

[22] Filed: Feb. 28, 1991

Related U.S. Application Data

[63] Continuation of Ser. No. 461,030, Jan. 4, 1990, abandoned.

[51] Int. Cl.[5] ..... A47L 13/12; A47L 13/16; A47L 13/22

[52] U.S. Cl. ..... 401/21; 15/228; 15/231; 401/22; 401/27; 401/131; 401/138; 401/208

[58] Field of Search ..... 401/21, 22, 24, 27, 401/208, 131, 138; 15/228, 99, 231

[56] References Cited

U.S. PATENT DOCUMENTS

| | | | |
|---|---|---|---|
| 199,929 | 2/1878 | Nichols | 401/131 |
| 339,529 | 4/1886 | Cranston | 401/208 |
| 899,725 | 9/1908 | Goodier | 15/228 |
| 899,726 | 9/1908 | Goodier | 15/99 X |
| 1,130,064 | 3/1915 | Buchanan . | |
| 2,977,615 | 4/1961 | Szczepanski | 401/22 |
| 3,457,016 | 7/1969 | Gotberg | 401/138 X |
| 4,510,642 | 4/1985 | Ingermann et al. . | |
| 4,550,467 | 11/1985 | Johnson et al. . | |
| 4,562,610 | 1/1986 | Davis et al. | 15/99 X |

*Primary Examiner*—Steven A. Bratlie

[57] ABSTRACT

A floor cleaning apparatus is provided using indexing fabric rolls to furnish the cleaning surface. The rolls are contained within a replaceable cassette unit. The cassette is mounted within a housing which is attached to an elongated handle.

7 Claims, 3 Drawing Sheets

FLOOR CLEANING USING INDEX FABRIC ROLLS IN REMOVABLE CASSETTE

This application is a continuation of application Ser. No. 07/461,030, filed Jan. 4, 1990, now abandoned.

BACKGROUND OF THE INVENTION

This invention relates to the art of cleaning and more particularly to the art of floor cleaning.

The task of mopping a floor, as it has conventionally been practiced, is laborious and time consuming. Much of this difficulty can be attributed to the requirements of mop wringing and bucket carting. Various mops have been developed to make the task of mopping easier. For example, some mops have a slightly simplified wringing process, such as those currently available with sponge heads. These mops, however, still require the use of a bucket. Other mops, like that shown in U.S. Pat. No. 1,130,064, use a rolled fabric for cleaning. Such a device offers some improvements over conventional mops, but is onerous to use because the fabric rolls are difficult to advance and replace. Somewhat similar configurations are shown in U.S. Pat. Nos. 4,510,642 and 4,550,467. These devices, primarily intended for use as bowling lane dusters, are also difficult to use. Therefore, significant room for improvement exists in the art.

SUMMARY OF THE INVENTION

It is thus an object of the invention to provide an improved cleaning apparatus.

It is a further object of the invention to provide a floor cleaning apparatus which can be used without wringing and without a bucket as is required with conventional mops.

It is a further and more particular object of the invention to provide a floor cleaning apparatus using a fabric for cleaning which is easier to use than prior art devices.

These as well as other objects are accomplished by a cleaning apparatus comprising a handle, a housing mounted to the handle and a cassette detachably attached to the housing. A first roller for dispensing a fabric, as well as a second take-up roller and cleaning pressure surface are contained within the cassette. Means for advancing the fabric from the first roller to the second roller are also provided.

DETAILED DESCRIPTION

In accordance with this invention, it has been found that an apparatus may be provided to make the heretofore burdensome task of mopping a floor quicker and easier. While reference is made throughout the disclosure to floor cleaning, it is understood that the apparatus may be used to clean other similar surfaces, such as ceilings and walls, equally well.

Figure 1:
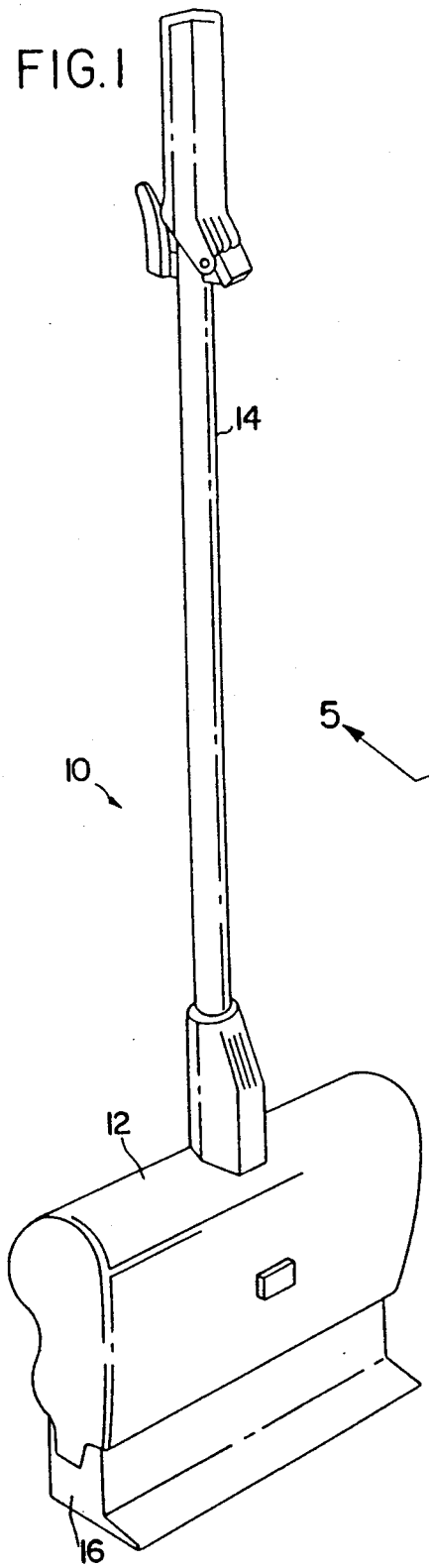
FIG. 1 is a perspective view of an apparatus constructed in accordance with the invention.
Figure 2:
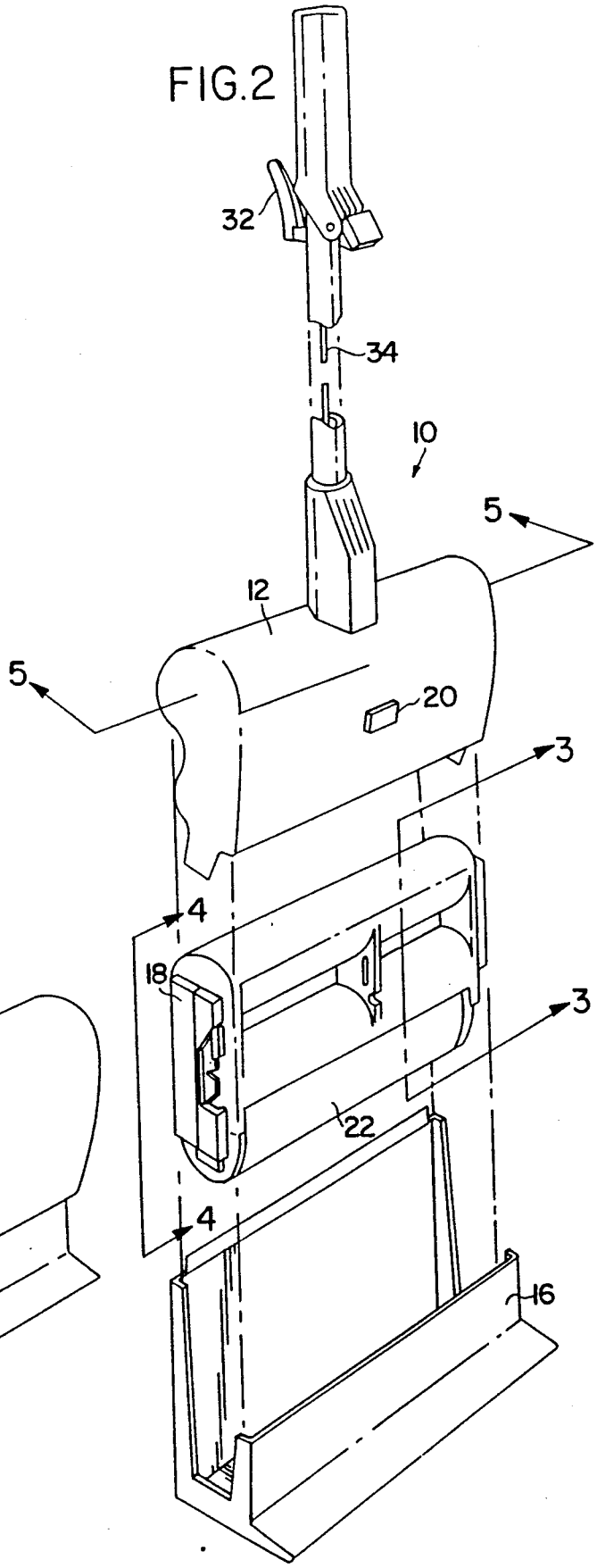
FIG. 2 is a partial assembly view of the apparatus of FIG. 1.

FIG. 1 illustrates a floor cleaning apparatus 10 constructed in accordance with the invention. A housing 12 is attached to a handle 14. Apparatus 10 is stored when not in use in mounting receptacle 16 which maintains apparatus 10 in an upright position. The cassette 18 of the apparatus 10 is shown in FIG. 2. Cassette 18 mounts snugly within housing 12 and is detachable by release button 20. Cassette 18 is therefore an easily replaceable unit. The cleaning surface is shown at 22. It should be noted that between uses receptacle 16 completely contains surface 22, thereby also containing moisture and contaminants.

Figure 3:
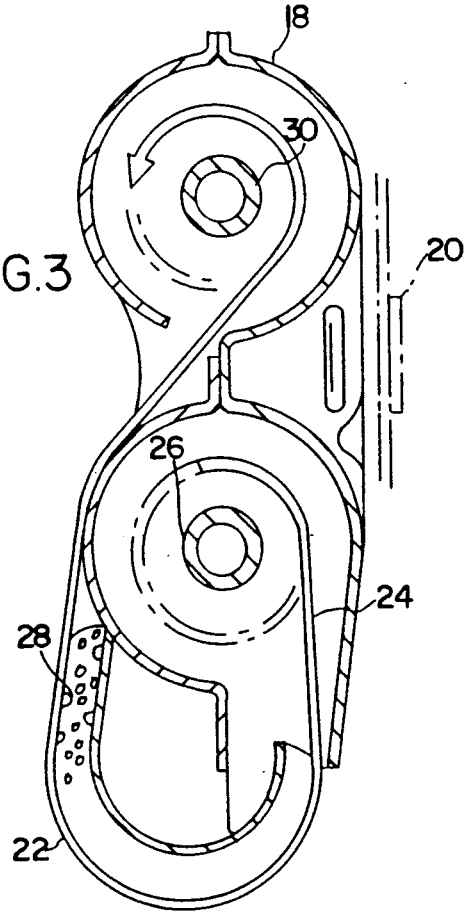
FIG. 3 is a cross-sectional view along line 3—3 of FIG. 2.

FIG. 3 illustrates some of the internal components of cassette 18. A fabric 24 is dispensed from dispensing roller 26, passes over pressure surface backing 28 and is collected on collecting roller 30. The section of fabric contacting backing 28 forms surface 22. Fabric 24 is preferably a non-woven fabric which may be any of the well-known type utilized as a pre-moistened wipe. An example of such a fabric is illustrated in U.S. Pat. No. 3,978,185. Another example is the fabric used in the wipes sold at the retail level under the trademark SPIFFITS. These examples are hereby incorporated by reference.

Figure 5:
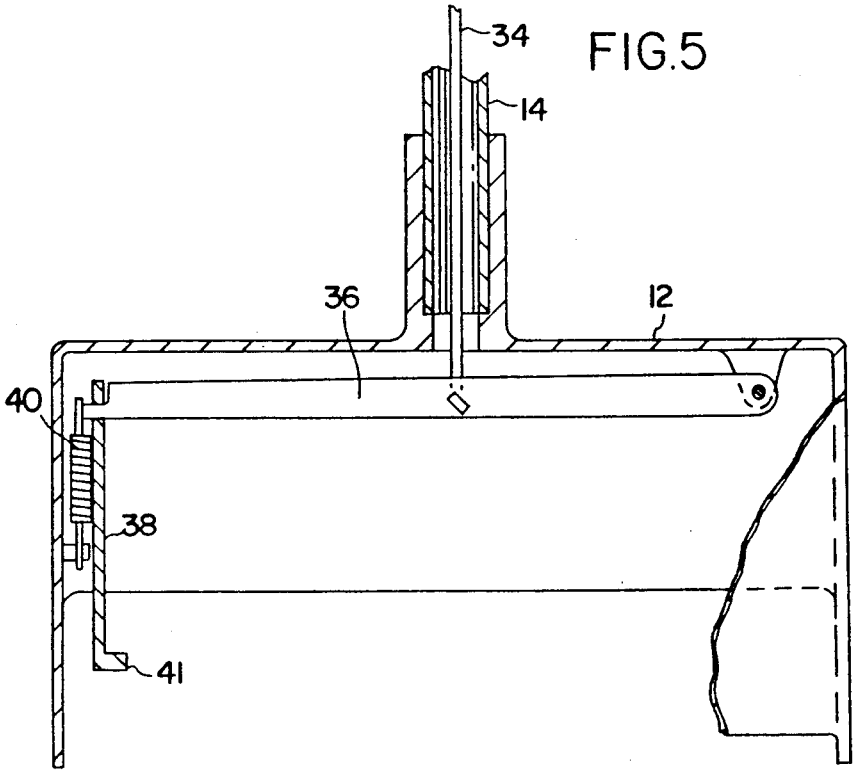
FIG. 5 is a cross-sectional view along line 5—5 of FIG. 2.
Figure 4:
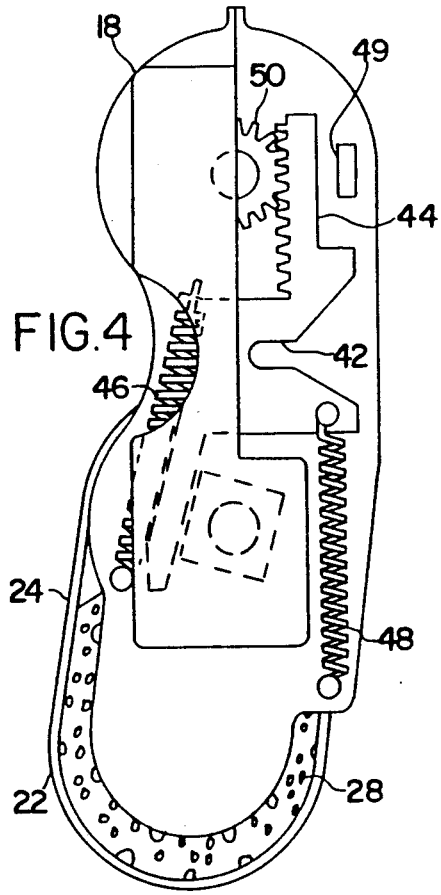
FIG. 4 is a cutaway view, partially in phantom, along line 4—4 of FIG. 2.

FIGS. 4 and 5 illustrate the means used to index fabric 24 from roller 26 to roller 30 to expose clean fabric after each use. Activation means, such as trigger 32 (FIG. 2), are connected to rod 34. If trigger 32 is pressed, the force imposed upon arm 36 by rod 34 overcomes the force of spring 40 and pulls arm 36, along with hook member 38, upwardly.

When cassette 18 is mounted within housing 12, hook 41 of hook member 38 fits within notch 42 of ratchet 44. As hook member 38 is pulled upwardly as described above, the force of springs 46 and 48 is overcome. Ratchet 44 is moved from its at-rest position against stop 49 into contact with gear 50, which then rotates a predetermined amount. Since gear 50 is attached to and is an extension of roller 30, roller 30 rotates as well. In this way, fabric 24 advances.

Figure 6:
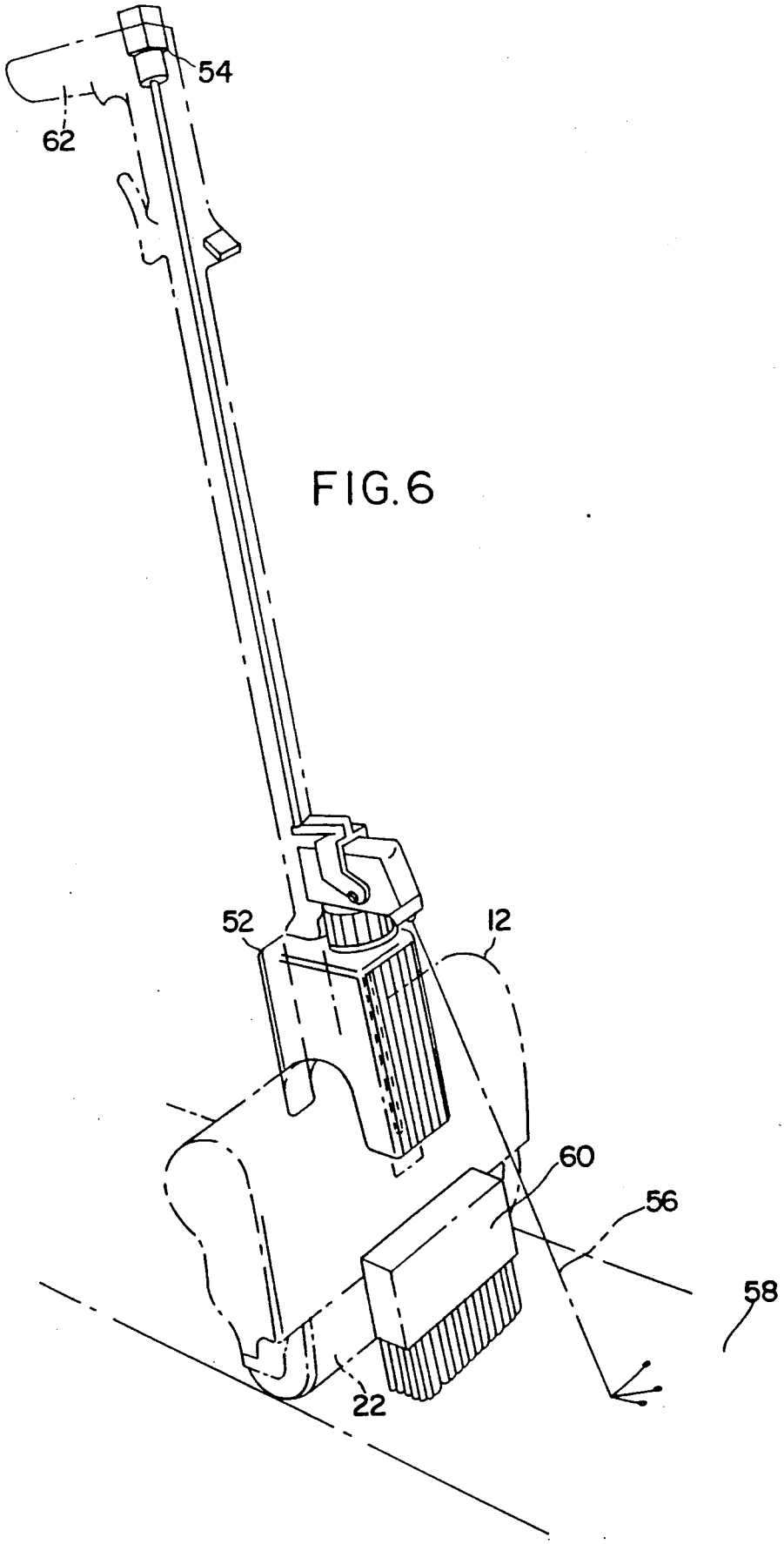
FIG. 6 is a perspective view, partially in phantom, of the apparatus shown in FIG. 1 equipped with a fluid dispensing container, a scrubbing brush and a pistol grip and further illustrating the application of the fluid from the dispensing container to an area to be cleaned.

FIG. 6 shows some notable modifications of the invention. A fluid dispensing container 52, activated by button 54, dispenses a liquid stream 56, such as wax or soap, onto an area 58 to be cleaned. As the user draws surface 22 across area 58, it contacts the liquid. However, the apparatus can be easily modified so that the stream contacts the fabric directly. Other modifications include the addition of a scrubbing brush 60 to the housing 12, which can be of aid with more difficult cleaning problems. Furthermore, a more ergonomically efficacious grip, like pistol-grip member 62 may be used.

It is apparent that the invention disclosed herein makes the task of floor cleaning quicker and easier. As many variations will be apparent from a reading of the above description, such variations are embodied within the spirit and scope of this invention as defined by the following appended claims.

I claim:

1. A cleaning apparatus comprising:

a handle;

a housing mounted on said handle, said housing having means thereon for releasably securing a cassette;

a cassette securely and releasably maintained within said housing by said means for releasably securing said cassette;

a first roller within said cassette for dispensing a fabric;

a second roller within said cassette for collecting said fabric after its use;

said cassette having a pressure surface backing in contact with said fabric whereby said fabric can be applied to an area to be cleaned; and means for advancing said fabric from said first roller to said second roller.

2. The apparatus according to claim 1 further including a dispensing container for dispensing a liquid to contact said fabric.

3. The apparatus according to claim 1 further including a pistol-grip member attached to an end of said handle for providing the user an ergonomically efficacious means of holding said apparatus.

4. The apparatus according to claim 1 further including a scrubbing brush mounted on said housing.

5. The apparatus according to claim 1 further including a mounting receptacle for receiving said housing and maintaining said cleaning apparatus in an upright position.

6. The apparatus according to claim 1 wherein said means for advancing said fabric comprises activation means mounted on said handle in communication with a ratchet mounted within said cassette.

7. The apparatus according to claim 1 wherein said fabric is a non-woven fabric.

* * * * *